United States Patent [19]

Thompson et al.

[11] 4,094,149

[45] June 13, 1978

[54] OFFSHORE STRUCTURE IN FRIGID ENVIRONMENT

[75] Inventors: Gene D. Thompson, Denver, Colo.; Hans O. Jahns, Houston, Tex.

[73] Assignee: Exxon Production Research Company, Houston, Tex.

[21] Appl. No.: 709,975

[22] Filed: Jul. 30, 1976

[51] Int. Cl.[2] ..... E02B 3/00

[52] U.S. Cl. ..... 61/1 R; 61/36 A; 61/103

[58] Field of Search ..... 61/86, 103, 1, 36 A; 62/66, 260, 235

[56] References Cited

U.S. PATENT DOCUMENTS

| | | | |
|---|---|---|---|
| 2,712,854 | 7/1955 | Creighton | 166/242 |
| 3,347,319 | 10/1967 | Little John | 166/142 |
| 3,695,358 | 10/1972 | Blount | 166/DIG. 1 |
| 3,750,412 | 8/1973 | Fitch et al. | 61/103 |
| 3,760,876 | 9/1973 | Blount et al. | 166/DIG. 1 |
| 3,766,737 | 10/1973 | Howard | 61/103 |
| 3,796,273 | 3/1974 | Rininger | 166/.5 |
| 3,798,912 | 3/1926 | Best et al. | 61/103 |
| 3,823,773 | 7/1974 | Nutter | 166/.5 |
| 3,849,993 | 11/1974 | Robinson et al. | 61/103 |
| 3,902,553 | 9/1975 | Jergins | 166/.5 |
| 3,952,527 | 4/1976 | Vinieratos et al. | 61/103 |
| 3,990,253 | 11/1976 | Lea et al. | 165/45 |

FOREIGN PATENT DOCUMENTS

| | | | |
|---|---|---|---|
| 972,975 | 8/1975 | Canada | 61/103 |
| 735,233 | 4/1932 | France | 62/235 |

*Primary Examiner*—William E. Wayner
*Assistant Examiner*—Robert J. Charvat
*Attorney, Agent, or Firm*—John S. Schneider

[57] ABSTRACT

An artificial ice structure for use as, for example, a base for oilfield operations or a road, is constructed in an offshore frigid environment where the water is covered by a sheet of floating ice. A berm or dike enclosing a predetermined area is built on the ice sheet to contain flood water and a trench is cut through the ice sheet around the perimeter of the dike to separate the predetermined area from the parent ice sheet and thereby form an island. The island of predetermined area is flooded with water and the water is allowed to freeze and weight the island down until essentially the entire ice mass of the island is resting on the ground underlying the body of water. After the structure is grounded, flooding with water is continued until the island has sufficient mass, in combination with other defensive measures, to resist the forces imposed by movement of the surrounding fast ice. When designed to support a base for oilfield operations, a silo arrangement, which extends through the ice structure and into ground below the mudline, is utilized to install separable well control equipment below the ground level. Also, a large level operating surface of a desired elevation above the surrounding ice is formed. The silo arrangement is also applicable for use with islands formed wholly or partly of fill materials.

22 Claims, 14 Drawing Figures

FIG. 1.
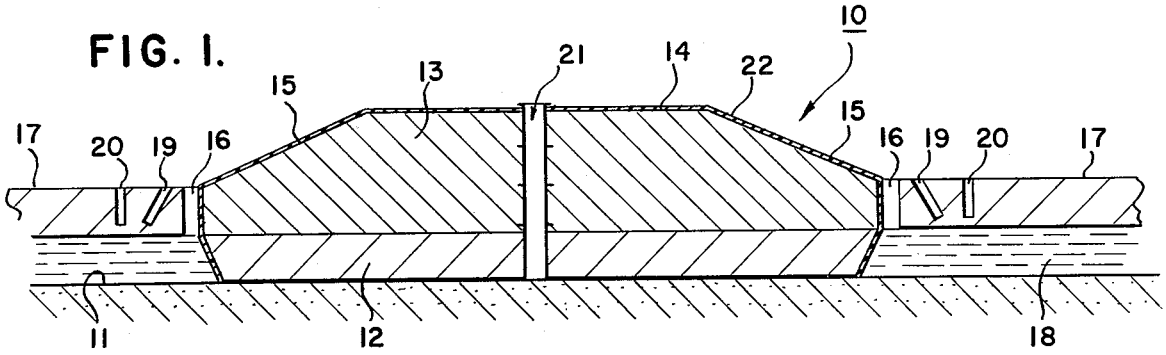
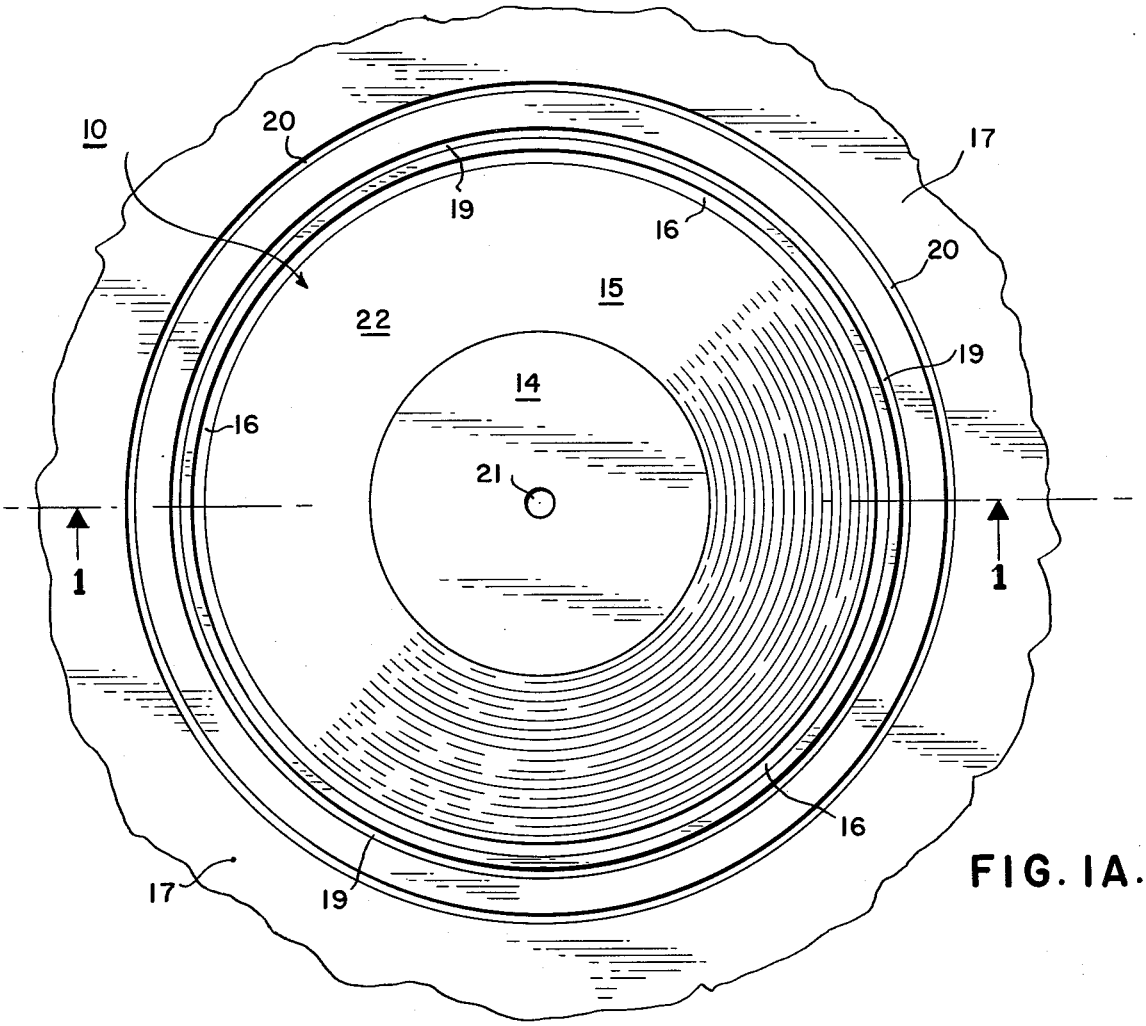
FIG. 1A.
FIG. 6.
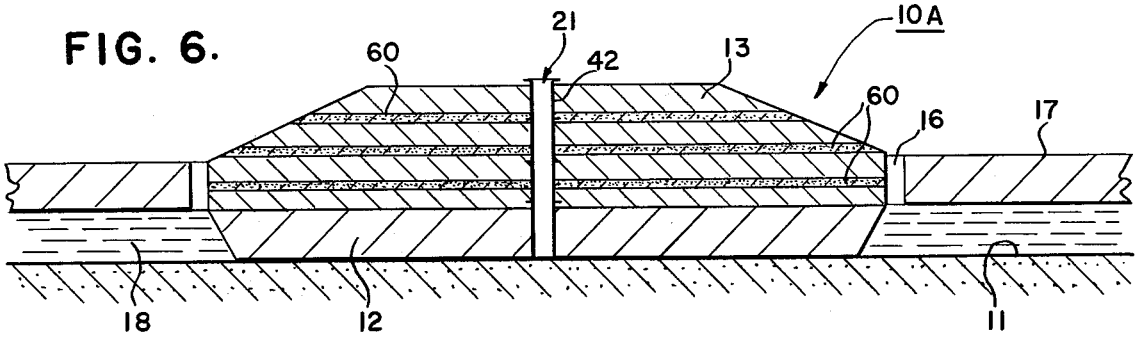

FIG. 2A.
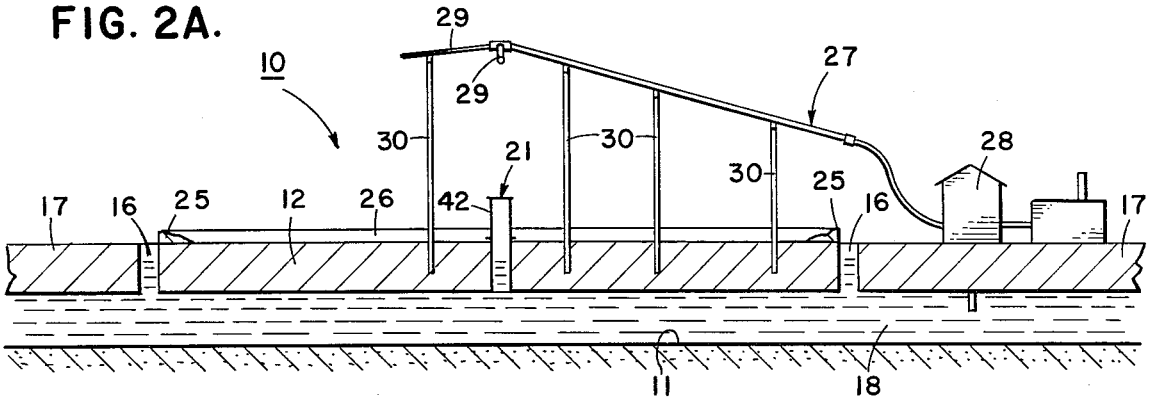
FIG. 2B.
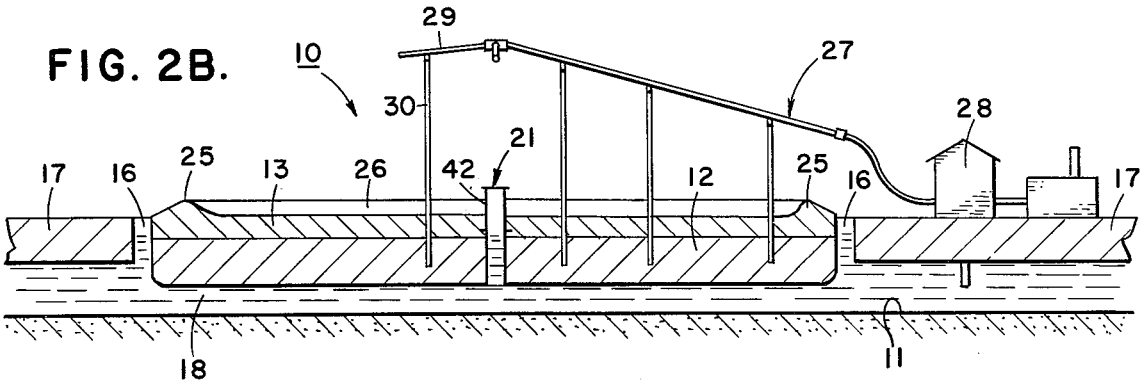
FIG. 2C.
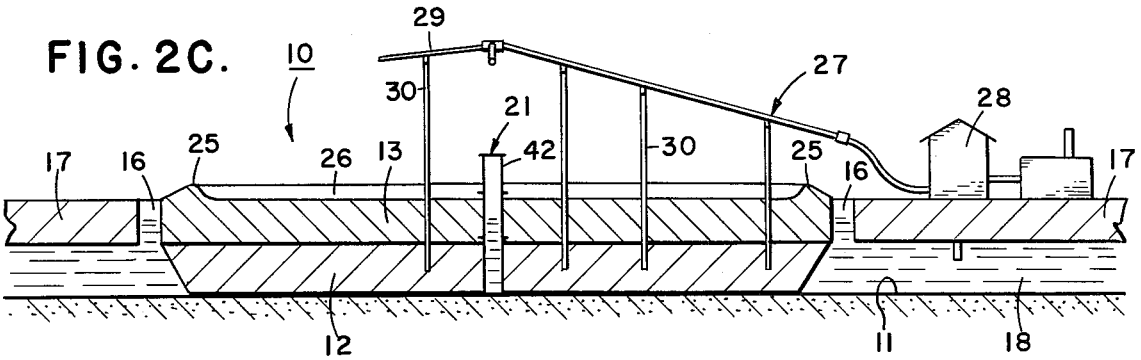
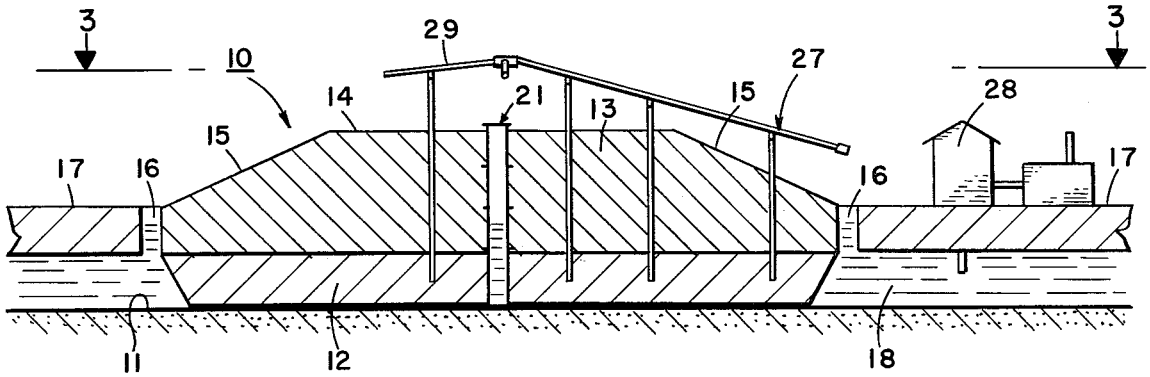
FIG. 2D.

FIG. 3.
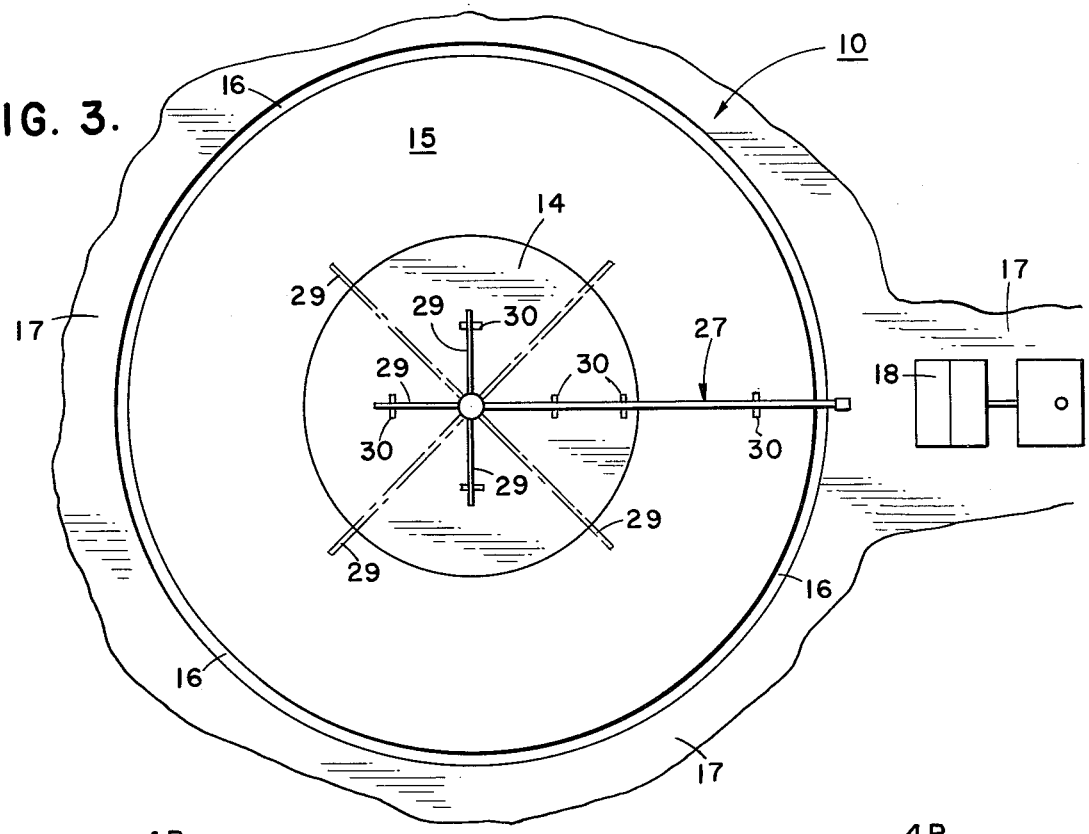
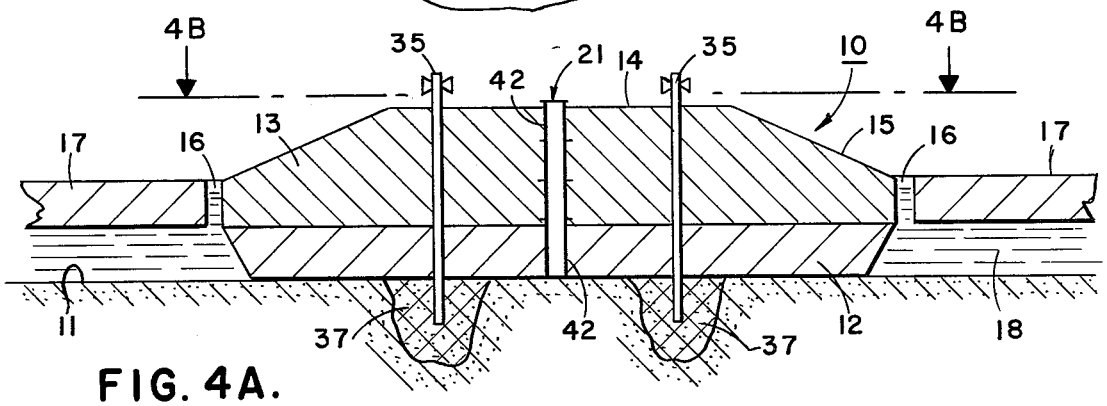
FIG. 4A.
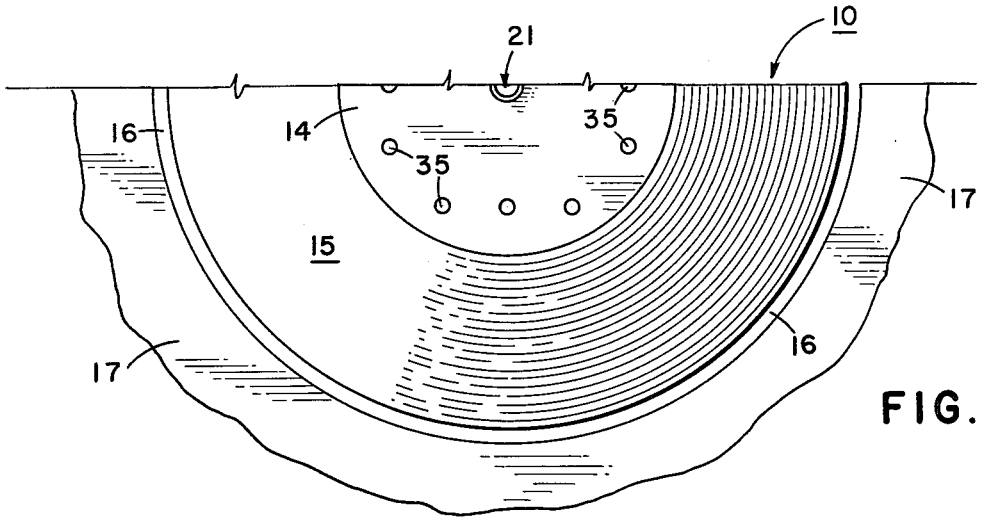
FIG. 4B.

FIG. 7A.
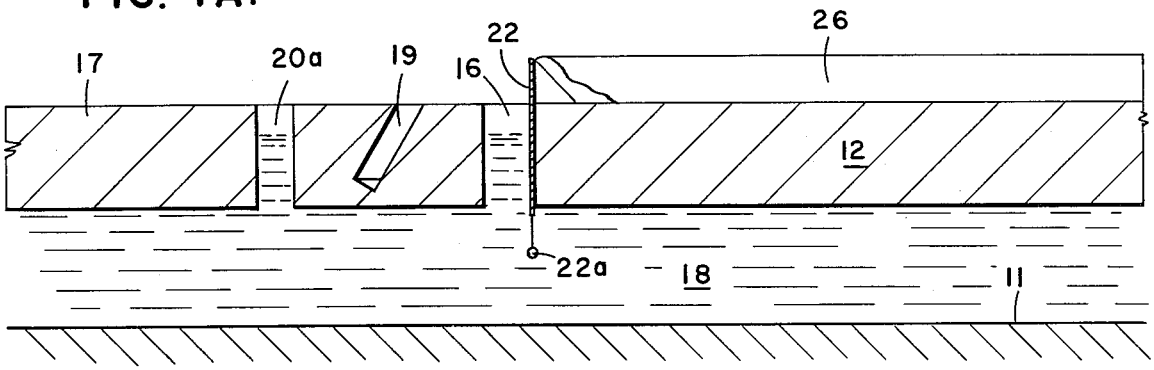
FIG. 7B.
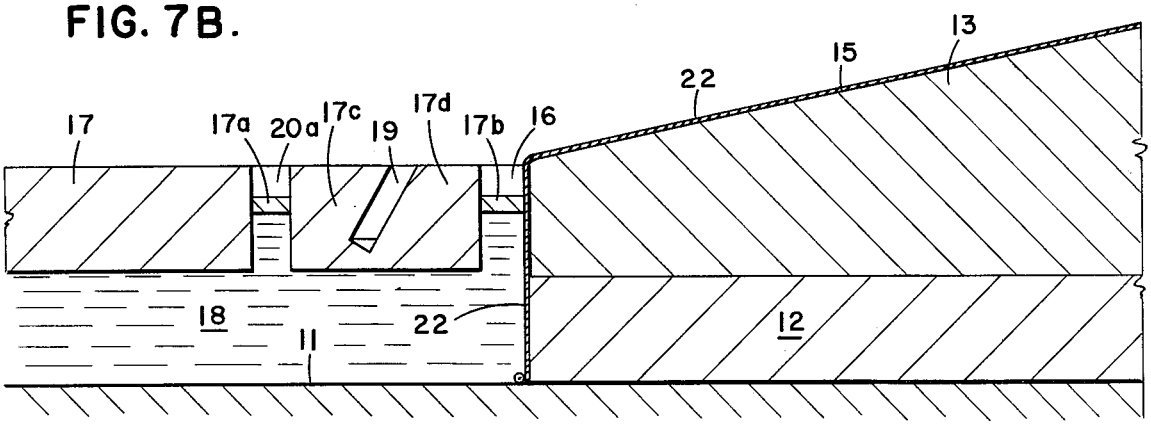
FIG. 8A.
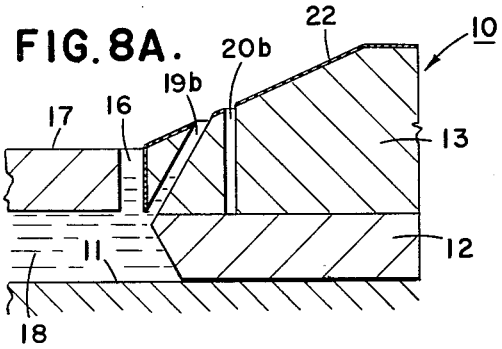
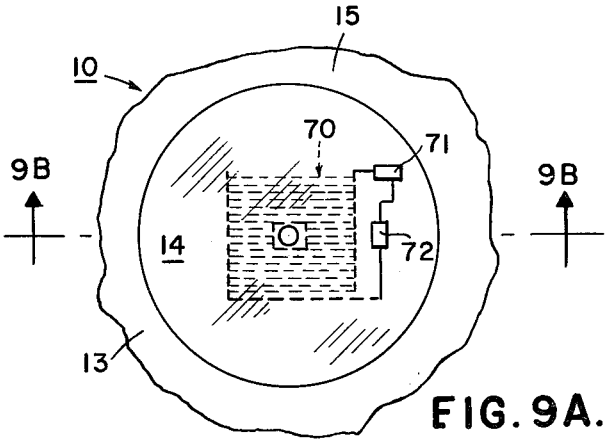
FIG. 9A.
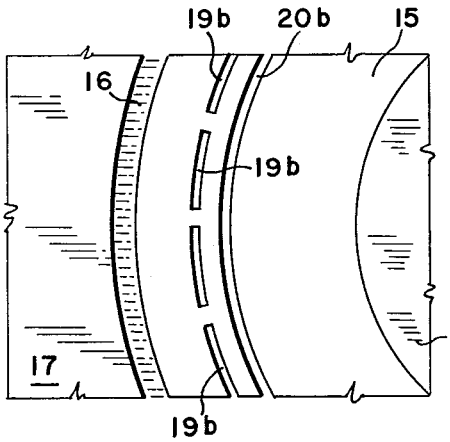
FIG. 8B.
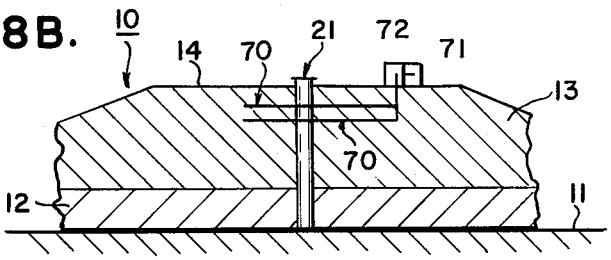
FIG. 9B.

OFFSHORE STRUCTURE IN FRIGID ENVIRONMENT

BACKGROUND OF THE INVENTION

The present invention concerns an artificial ice structure constructed in an offshore frigid environment.

Artificial gravel, sand and silt islands have been constructed in the polar regions to serve as a base for drilling, producing and related oilfield operations. However, in most such offshore areas the construction period is limited to the brief summer season. Also, dredging operations using available materials introduce high construction costs.

The present invention provides an improved base for oilfield operations and/or a road system in offshore polar regions. In such regions, out to about sixty feet of water depth, a continuous sheet of ice, known as fast ice, forms in the winter to a maximum thickness of about seven feet. Although fast ice appears to be stationary, it can move at rates of several feet per hour with a seasonal movement of as much as one hundred feet or more. The artificial structure must have sufficient mass, in combination with other defensive measures, to resist the forces imposed by movement of the fast ice and to provide maximum well protection in the event lateral forces due to movement of the fast ice should cause the ice structure to move. A silo well bore protection system, which may also be utilized with artificially formed non-ice structures, extends through the ice structure and into the sea floor and houses separable well control equipment located below the sea floor.

SUMMARY OF THE INVENTION

Briefly, the present invention includes an artificial offshore ice structure to be used, for example, as a base for drilling, producing and related oilfield operations and/or as a road, and a method for constructing such structure in an arctic offshore environment where the water is covered by a floating sheet of ice. The method comprises building a berm or dike on the outer edge of a predetermined area of such sheet of ice, cutting a slot through, or nearly through, the sheet of ice outside the perimeter of the dike to ensure separation of the predetermined area from the surrounding ice sheet and form an island and pumping water at controlled rates and amounts to prescribed locations on the island, allowing such water to freeze on top of the island and weight it down until essentially the entire island mass of ice is resting on the ground underlying the water. After the island has been grounded flooding is continued until the island has a predetermined mass and a large level operating surface of desired elevation above the surrounding natural ice sheet has been constructed. The dike is built up as may be necessary to retain the flooding water during such continued flooding. Heat extraction devices are installed through the island ice mass and into the ground underlying the water to remove heat from the ground to accelerate freezing thereof and aid in anchoring the island in place, and a slot or slots are cut into the surrounding natural ice sheet around and/or on the island to form points of weakness such that if the fast ice sheet moves it will fail at such slots, piling up on the edge of the island before exerting a large enough force to cause the island to move. Refrigeration tubes may be installed to aid in maintaining strength of the ice island. Also, explosives and melting may be employed to resist movement of the surrounding ice sheet. Means to strengthen and insulate the ice island may be provided. In addition, an offshore arctic silo arrangement is installed within the island to provide housing protection for a submudline well control assembly. Such protection may also be provided in artificial islands constructed wholly or partly of sand, gravel or other type fill material.

BRIEF DESCRIPTION OF THE DRAWINGS

FIG. 1 is a sectional side view illustrating the geometry and configuration of the ice structure of the invention;

FIG. 1A is a top view of FIG. 1;

FIGS. 2A to 2D are side views illustrating stages in construction of the ice structure of FIG. 1;

FIG. 3 is a plan view of the ice structure of FIG. 2D;

FIG. 4A is a sectional side view showing heat extraction devices installed in holes drilled through the ice structure;

FIG. 4B is a fragmentary plan view taken along lines 4B—4B of FIG. 4A;

FIG. 6 illustrates a modification of the ice structure of FIG. 1;

FIGS. 7A and 7B are enlarged, fragmentary views illustrating slots in the fast ice and insulation covering the outer edge of the ice structure;

FIG. 8A is a fragmentary view illustrating the formation of slots in the ice structure;

FIG. 8B is a plan view of FIG. 8A;

FIG. 9A is a plan view of the ice structure illustrating the location of refrigeration tubes in the ice structure; and FIG. 9B is a view taken along lines 9B—9B of FIG. 9.

DESCRIPTION OF THE PREFERRED EMBODIMENTS

Figure 5:
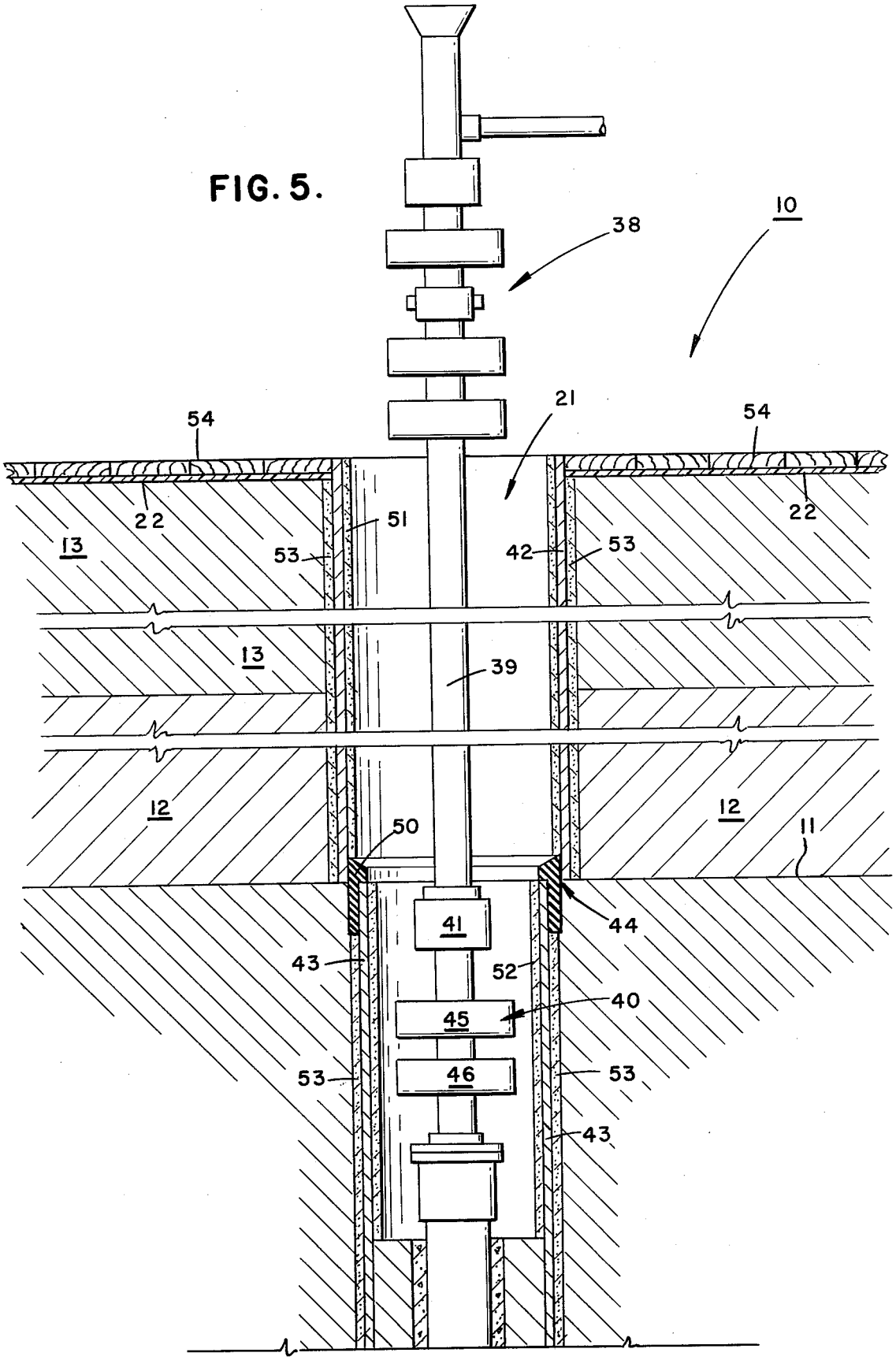
FIG. 5 is a side view illustrating the arrangement of the silo containing the well control assembly arranged in the ice structure.

Referring to FIGS. 1 and 1A there is shown an artificial ice island 10 resting on the sea floor 11. The ice island has a bottom layer of natural ice 12 on top of which is a mass of artificially made ice 13. A large, level operating surface 14, which defines the central core of the island, is at a desired elevation above the surrounding parent or natural ice sheet 17 which floats on the water 18. The slanting surface 15 surrounding surface 14 slopes to the level of natural ice 17. A peripheral slot or trench 16 separates ice island 10 from natural ice 17. Two sets of slots, one slanted, 19, and one vertical, 20, are cut around ice island 10 in natural ice 17. Slots 19 and 20 are shown cut almost through natural ice 17. (In FIGS. 7A and 7B vertical slot 20a is cut entirely through natural ice 17.) A silo 21, the details of which are described with respect to FIG. 5, extends through ice island 10. The entire outer surface of the ice island above and below the level of water 18 including surfaces 14 and 15 may be covered by an insulating cover 22 to extend the life of the exposed surfaces.

Stages in the construction of ice island 10 are illustrated in FIGS. 2A to 2D. Referring to FIG. 2A an ice berm or dike 25 is constructed to surround or enclose a predetermined area 26 by piling snow, spraying the snow with water, and allowing the sprayed snow to freeze. Ice dike 25 contains the flood water which is distributed through a water distribution system 27 for flooding the ice island to form artificial ice 13 shown in FIG. 2D. System 27 includes pumps, not shown, located in a pump house 28 positioned on natural ice 17 outside the periphery of island 10 and horizontally extending pipes 29 e.g. 6 and 4 inch outside diameter pipes, which, as shown in FIG. 3, may be arranged to extend radially from the centerpoint of the island. Pipes 29 are supported on vertical supports 30 anchored initially in natural ice 12 and later also in artificial ice 13 as that ice builds up. The pipes and supports may be removed once the ice island has been completed.

Prior to flooding area 26 the trench or slot 16 is cut through natural ice 17 around the perimeter of ice dike 25. The predetermined area 26 of the island is separated in this manner from natural ice sheet 17. The steps of constructing an ice dike, flooding the enclosed predetermined area and allowing the flooding water to freeze are repeated until the natural ice 12 of the island has grounded as shown in FIG. 2C and are further repeated until ice island 10 has the configuration illustrated in FIG. 2D, which includes the large level operating surface 14 of desired elevation above surrounding natural ice 17. Each flood layer thickness is preferably small e.g. four inches to facilitate freezing. The ice dike is built up as it is needed to confine the flood water. The area flooded is preferably decreased as the ice island is built up to achieve the truncated cone configuration for the ice island. The water distribution system 27 pumps seawater to prescribed locations on the island at rates controlled to allow maximum freezing of water for the ambient conditions and to yield ice with satisfactory strength properties for supporting the loads that a drilling rig would exhibit.

As shown in FIGS. 2A through 2D silo 21 is made of prefabricated sections of caissons that are installed in the ice island as the ice island is being built. The portion of silo 21 contained within island 10 extends to mudline 11. The lower part of silo 21 may be a driven or jetted caisson that extends below the mudline.

Referring to FIGS. 4A and 4B a defensive measure employed to minimize ice forces and to restrict movement of ice island 10 is illustrated. Heat extraction devices 35 such as heat pipes and/or air convection piles are arranged in any desired pattern as illustrated in FIGS. 4A and 4B. Such heat extraction devices are similar to those designed to provide permafrost protection adjacent arctic pipelines and other arctic foundations and are described in a paper entitled "Passive Refrigeration for Arctic Pile Supports" by J. W. Galate presented at the Petroleum Mechanical Engineering Conference, Tulsa, Oklahoma, Sept. 21–25, 1975. The heat pipes and/or air convection piles are installed to extend through the ice island and into sea floor 11 about 10 feet, for example, and they function to extract heat from the sea floor thereby accelerating freezing of the sea floor and bonding of the ice island to its foundation. While only a few heat extraction devices are shown, as many as two hundred such devices may be installed to freeze the sea floor below ice island 10, as indicated by the freeze bulbs 37.

The slots illustrated in FIGS. 1, 1A, 7A and 7B constitute another defensive measure. Slots 19 and 20 (or **20*a*) form a point of weakness in natural ice 17 such that when the fast ice moves it will break at those slots and pile up on the edge of ice island 10 before exerting a large enough force to cause the island to move. As shown in FIGS. 7A and 7B, preferably, slanted slot 19 is continuous and terminates in and almost through natural ice 17 and slot 20*a* is cut entirely through natural ice 17. However, either type slot may be formed in spaced apart sections which extend entirely through natural ice 17. Insulation curtain 22 covers the outer surface of the ice island. As it is being formed the curtain may suitably be weighted by a weight 22*a* and lengthened as the ice island is built up. In FIG. 7B there is shown a layer of ice 17*a* frozen in slot 20*a* and a layer of ice 17*b* frozen in slot 16. These layers of ice might form after slots 20 and 16 have been cut. In FIG. 7A ice island 12 is beginning to be formed and is floating whereas in FIG. 7B ice island 10 has been grounded. In the event natural ice sheet 17 moves toward ice island 10 ice segment 17*c* would pivot causing that segment to sever from ice segment 17*d* at slot 19 and aid in sliding movement of segment 17*c* on segment 17*d***.

A modification of the slots is shown in FIGS. 8A and 8B. In those Figs. a slanted slot **19*b* and a vertical slot 20*b* are cut in the periphery of ice island 10. Slot 19*b* is cut entirely through the island edge and as seen in FIG. 8B is formed in spaced apart sections. Slot 20*b* is cut only partly through ice island 10 (to natural ice 12**).

A further modification is illustrated in FIGS. 9A and 9B in which a series of spaced apart refrigeration tubes 70 are connected to refrigeration equipment including a compressor 71 and a condenser 72. As shown in FIG. 9B tubes 70 are shown arranged in layers. Such tubes may be in the form of mats, as indicated, and are preferably arranged at the center of the ice island at the location of the silo to aid in the support of drilling, completion and producing equipment. The tubes may be similar to those used in refrigeration systems employed for freezing ice skating rinks.

In FIG. 5 arctic silo 21 is shown in more detail. A conventional well control blowout preventer (BOP) stack 38 is mounted on a riser pipe 39 which extends through the upper portion of silo 21 and is connected to the submudline well control assembly 40 by a connector 41 located within the lower portion of silo 21. The upper portion of silo 21, which includes prefabricated sections of caissons 42, of e.g. 10 feet diameter, as has been mentioned earlier herein, is installed in ice island 10 as it is being built (see FIGS. 2A to 2D). The lower portion of silo 21 includes a caisson 43 which may be driven or jetted into sea floor 11 to provide housing protection for submudline well control assembly 40 which, as shown, includes shear rams 45 and pipe rams 46. A weak point, indicated at 44, is formed at the mudline (11) connection between caissons 42 and 43, whether caisson 43 is made integral with or separate from (as shown) caisson 42. Weak point 44 is provided so that in the event ice island 10 moves only caisson 42 will be disturbed leaving submudline caisson 43 intact. In that way submudline well control assembly 40 will not be disturbed after BOP stack 38, riser pipe 39 and connector 41 are disconnected therefrom.

After caisson 43 is in place the inner volume thereof is evacuated hydraulically and a watertight seal 50 is installed at the mudline connection between caissons 42 and 43. The inside area of caisson 42 is then coated with insulation 51 to prevent or retard melting of the surrounding natural and artificial ice 12, and 13, respectively, of the ice island through heat transfer. Similar insulation 52 may be provided on the inner area of caisson 43. In addition, insulation, indicated by numeral 53, may be provided on the outer areas of caissons 42 and 43. The protective covering 22 on the island's exposed surfaces is also shown in FIG. 5 along with rig matting 54 on which the rig is mounted.

Should the defensive measures fail and ice island 10 move, a new caisson 42 would be installed through the artificial and natural ice 12 and 13, respectively. The BOP stack 38 and associated riser pipe 39 and connector 41 would again be attached to submudline well control assembly 40. Connector 41 is preferably a remotely operable hydraulic connector, but may be any desired type connector used to connect fluid carrying conduits.

As an example of the dimensions of a suitable ice island for drilling an oil well assume an ice island grounded in ten feet of water. The predetermined flat surface area 14 is first determined. Most arctic drilling rigs require a three hundred and fifty by three hundred and fifty feet operating area or a circle approximately five hundred feet in diameter. An island having a central core of five hundred feet in diameter, nine feet free-board and a sloping skirt out to an outer diameter of nine hundred feet of the grounded portion of the island would provide a total surcharge (weight on bottom) of about one hundred and seventy million pounds. Assuming a friction factor of six-tenths such an island could resist a lateral ice load of about one hundred million pounds. If the outer diameter of the island at slot 16 is one thousand feet that corresponds to a load of one hundred kips per foot of island diameter. Use of the slotting technique of slotting natural ice 17 would reduce potential ice loads below this level. Much higher loads would be resisted once the island is frozen to bottom by means of heat extraction devices.

Brine drainage holes may be drilled vertically in and spaced over ice island 10 to provide a stronger, less saline ice island. They are preferably drilled through the entire ice thickness to the sea bottom and preserved by perforated pipe. The drainage holes function like water wells i.e. brine seeps into the hole and is then pumped or bailed out as it collects therein.

Reinforcing material may be added during the ice forming process to enhance the integrity and strength of the ice around the side and other areas where high shock loads are expected as, for example, sand, wood fiber, sawdust, etc. Such material may be fixed with the water and pumped to form the reinforced ice or such materials may be applied separately by spreading the material over the ice already formed and then covering it with additional water. Certain other reinforcing materials, as for example, boards, ropes, reinforcing rods, fabrics, etc. are applied separately.

The special defensive measures, such as slotting, heat pipes, air connection piles and, also, explosives, melting etc., reduce and resist the nominal pressure due to movement of the surrounding ice sheet. When explosives are used they may be imbedded around the periphery of ice island 10 such that they can be set up in an emergency (e.g. when ice island 10 starts to move) to relieve ice pressure temporarily. Melting may be employed by pumping warm water and distributing it along slot 16 to prevent refreezing of slot 16 and enlarge it and to reduce ice thickness in its vicinity. Such defensive measures enable the slot system to accommodate larger ice movement at low ice loads.

Artificial ice structures for use in oil and gas drilling and production operations and/or as roads may be constructed by other methods to shorten the construction period or extend the life thereof or increase the durability of the grounded structure to hostile forces. One such method is illustrated in FIG. 6 with respect to an ice island to be used for the aforementioned drilling and production operations. Ice island 10A is constructed in the same manner as described supra for the construction of ice island 10 except at predetermined times during such construction, flooding to form artificial ice 13 is halted and a layer of dense material 60, for example sand or gravel, is spread over the surface of the ice to a desired thickness. The step of adding a layer of such dense material between layers of artificial ice is continued as desired. Other such construction methods involve layers of fiber or plastic matting instead of or together with layers of the dense material and/or refrigeration tubes to accelerate freezing, to increase ice strength, promote freezing into the bottom sediments or delay spring thawing. Protective cover 22 may be a specially designed covering to insulate the artificial ice surface such as gravel, polyurethane, matting with air gap below etc. etc. Such coverings may be utilized where necessary to extend the life of the exposed surfaces. The sand or gravel layers could aid the aforementioned brine drainage by providing permeable layers within the ice island.

The ice island may be constructed in any frigid location in any body of water, salt or fresh, and, therefore, the terms "sea floor" and "sea bottom" as used herein mean the ground underlying any body of water, as for example, a sea, a lake, an ocean, a river etc. Also, the water used to build the island may be fresh water or salt water. Although the berm or dike is described herein as being constructed of frozen water or snow alone, it may also be any suitable type liquid retaining wall, as for example, one made of wooden forms and/or of sand or other available construction materials. In addition, the outer wall of the ice island may be built entirely vertical instead of partially sloped as shown and described herein. Also, the concept of the separable caisson housing and disconnectable well control equipment illustrated in and described with respect to FIG. 5 may be employed with any built up island or other grounded structure subject to the forces imposed by movement of the fast ice. Thus, it may be employed with a non-ice artificial island that is built up by piling up fill material such as gravel, silt etc. directly on the sea floor or on the natural ice sheet. In the latter case, the natural ice sheet may be cut at the edge of a predetermined area and then sunk to the sea bottom by the weight of the fill material. In the case where the fill material is piled directly on the sea floor the natural ice sheet may be cut away and removed and the island built up in open water from the sea floor to above the level of the natural ice sheet.

Other variations and changes may be made in the artificial structure and method of constructing it shown and/or described herein without departing from the scope of the invention as defined in the appended claims.

Having fully described the method, apparatus, objects and advantages of our invention we claim:

1. A method for constructing a structure in an arctic offshore environment comprising:

forming an artificial ice island extending from the sea floor to above the surface of the water; and installing a caisson entirely through said island to below said sea floor, said caisson being formed in two parts, one part extending through said island to said sea floor and the other part extending from said sea floor to below said sea floor, said caisson being separable at said sea floor upon movement of said island.

2. A method as recited in claim 1 including sealing the area between said upper and lower caisson parts.

3. A method as recited in claim 1 including installing lower well control equipment below said sea floor within said caisson and upper well control equipment in said caisson above said sea floor releasably connected to said lower well control equipment.

4. A method for building a base for oilfield operations in an arctic offshore enviroment in which the water is covered by a sheet of natural ice comprising:

selecting a predetermined area of said natural ice sheet at which to locate said base;

cutting a slot through or nearly through said natural ice sheet at the edge of said predetermined area to separate said predetermined area from said natural ice sheet to form an island base and weighting said island base down until the entire mass of said island base is resting on the sea floor; and installing a caisson entirely through said island base and to below said sea floor, said caisson being separable at said sea floor upon movement of said island.

5. A method as recited in claim 4 in which said caisson is formed in two parts, one part extending through said island base to said sea floor and the other part extending from said sea floor to below said sea floor.

6. A method as recited in claim 5 including sealing the area between said upper and lower caisson parts.

7. A method as recited in claim 4 in which said caisson is formed integral.

8. A method as recited in claim 4 including installing lower well control equipment below said sea floor within said caisson and upper well control equipment in said caisson above said sea floor releasably connected to said lower well control equipment.

9. A method for constructing an ice structure in an arctic offshore environment in which the water is covered by a sheet of natural ice comprising:

selecting a predetermined area of said natural ice sheet at which to locate said structure;

building a dike to contain water adjacent the periphery of said predetermined area;

cutting a first slot through or nearly through said natural ice sheet outside the perimeter of said dike to separate said predetermined area from said natural ice sheet and form an island;

flooding said island within said dike with water and allowing said water to freeze on top of said island to thereby weight said island down until the entire mass of said island is resting on the sea floor;

further flooding said island until a large operating surface above said natural ice sheet has been formed;

cutting at least a second slot in said natural ice sheet around said island to form points of weakness in said natural ice sheet in the event said natural ice sheet moves against said island; and installing heat extraction devices extending from the surface of said island into the sea floor to conduct heat from and thereby accelerate freezing of the ground underlying the water and aid in anchoring said island in place.

10. A method as recited in claim 1 including building up said dike to contain the water to be frozen during said flooding steps.

11. A method as recited in claim 10 including slanting said second slot downwardly in a direction away from said island.

12. A method as recited in claim 10 including cutting a third vertical slot in said natural ice sheet outside of said second slot.

13. A method as recited in claim 12 including installing a caisson in said island extending from said operating surface to below the sea floor.

14. A method as recited in claim 13 in which said caisson is formed in two parts, the upper part extending from said operating surface to said sea floor and said other part extending from said sea floor to below said sea floor.

15. A method as recited in claim 14 including sealing the area between said upper and lower caisson parts.

16. A method as recited in claim 15 in which said caisson is formed integral.

17. A method as recited in claim 13 including installing lower well control equipment below said sea floor within said caisson and upper well control equipment in said caisson above said sea floor releasably connected to said lower well control equipment.

18. A method as recited in claim 17 including adding reinforcing materials to said flood water to improve the integrity and strength of said island.

19. A method as recited in claim 18 including installing drainage holes in said island to provide a stronger less saline ice structure.

20. A method as recited in claim 19 including alternating layers of reinforcing material with layers of ice in the formation of said ice island.

21. A method as recited in claim 20 including covering the surface of said ice island with insulation material.

22. A method as recited in claim 21 including installing means to refrigerate said ice island.

* * * * *